United States Patent [19]

Bergstrom et al.

[11] Patent Number: 4,674,662

[45] Date of Patent: Jun. 23, 1987

[54] DISPENSER FOR BOTTLED LIQUID

[75] Inventors: Jerice Bergstrom; Jon Bergstrom, both of Norwich, Vt.

[73] Assignee: Ambience, Inc., Norwich, Vt.

[21] Appl. No.: 743,462

[22] Filed: Jun. 11, 1985

[51] Int. Cl.[4] ..... B65D 83/00

[52] U.S. Cl. ..... 222/399; 222/470; 215/360; 294/31.2

[58] Field of Search ..... 222/394, 399, 400.7, 222/470, 474, 152, 80, 82, 323, 324, 389; 169/71, 30; 294/31.2; 215/358, 360

[56] References Cited

U.S. PATENT DOCUMENTS

| | | | |
|---|---|---|---|
| 1,056,394 | 3/1913 | Schmolle | 222/399 |
| 1,554,348 | 9/1925 | Hawking | 222/399 |
| 2,274,973 | 3/1942 | Bryant | 294/31.2 |
| 2,441,892 | 5/1948 | Mattoon | 294/31.2 |
| 2,482,778 | 9/1949 | Joerren | 222/399 |
| 2,595,317 | 5/1952 | White, Jr. | 222/399 |
| 3,530,587 | 9/1970 | Anderson | 222/389 |
| 3,556,356 | 1/1971 | Mockesch | 222/399 |
| 3,612,354 | 10/1971 | Sitton et al. | 222/399 |
| 3,883,043 | 5/1975 | Lane | 222/152 |
| 4,392,578 | 7/1983 | Fipp et al. | 222/399 |

*Primary Examiner*—Joseph J. Rolla
*Assistant Examiner*—Kenneth Noland
*Attorney, Agent, or Firm*—Sughrue, Mion, Zinn, Macpeak, and Seas

[57] ABSTRACT

A dispenser for bottled liquid is provided comprising a housing attached to the bottle, the housing having a chamber for a source of pressurized gas, and a stopper for the neck of a bottle having a conduit connecting the stopper and the housing containing the pressurized gas. The stopper has ingress bores whereby the gas may be introduced into the bottle and an egress bore whereby the liquid in the bottle may be dispensed. The stopper has a slider with compressible and expandable means thereon and an operator to move the slider whereby the compressible material functions to seal the neck of a bottle.

1 Claim, 9 Drawing Figures

DISPENSER FOR BOTTLED LIQUID

BACKGROUND OF THE INVENTION

1. Field of the Invention

This invention pertains to a dispenser for bottled liquid which includes a stopper assembly for the neck of the bottle and a housing unit attached to the bottle.

2. Background of the Prior Art

The prior art discloses dispensers for wine bottles which include stoppers and/or cap assemblies which permit introduction of pressurized gas to dispense the contents of the bottle. Representative of the prior art are the following list of patents and copies are attached for the record.

| Patentee | Patent No. | Issue Date |
|---|---|---|
| L. T. Ward | 2,189,643 | Feb. 6, 1940 |
| W. Mack | 2,921,711 | Jan. 19, 1960 |
| Lane | 3,883,043 | May 13, 1975 |
| Haydon | 4,011,971 | Mar. 15, 1977 |
| Fipp et al. | 4,392,174 | Jul. 12, 1983 |
| Heuser | 4,473,174 | Sep. 25, 1984 |

Heuser (U.S. Pat. No. 4,473,174) discloses a stopper assembly for wine bottles and it includes a cap assembly 18 having a chamber 22 to receive a carbon dioxide cartridge 24. There is no disclosure of using a stopper having means to expand same against the inside neck of the bottle.

Fipp (U.S. Pat. No. 4,392,578) discloses a stopper for wine bottles which includes a stopper plug 21 for inserting into the neck 12 of the bottle 10. The handle 23 has a gas reservoir 162 and a release valve 163. The bladder 30 is expanded thus forcing the contents out of the bottle. The stopper device also includes means for injecting a protective inert gas into the bottle which serves as a protective barrier.

Lane (U.S. Pat. No. 3,883,043) is a dispenser for a wine bottle and it includes a portion 1 adapted to fit over the neck of a bottle and holder 9 for a gas filled pressurized vessel 81 together with a release handle 13. The device includes a tube 25 and a pipe 41 which are inserted through the stopper or seal 33.

Haydon (U.S. Pat. No. 4,011,971) also shows use of a tube insertable through the cork of a bottle; Mack (U.S. Pat. No. 2,921,711) discloses use of a screw on type cap and Ward (U.S. Pat. No. 2,189,643) is a dispensing apparatus in the form of a tank 1 which is detachably secured by a screw connector 2 to a dispensing head 3.

SUMMARY OF THE INVENTION

This invention involves a unique dispenser for bottled liquid, especially wine, which is easy and inexpensive to manufacture.

It is another object of this invention to provide a dispenser for wine bottles which includes a housing or attachment to the bottle, which housing contains a source of pressurized gas and controls therefor.

It is yet another object of this invention to provide a unique stopper communicating with the housing for the ingress of pressurized gas for displacing the wine in the bottle.

And yet another object of the invention is to provide a unique stopper with an egress passage and a spout for dispensing of the wine.

And still another object of the invention is to provide a stopper with means to permit an airtight seal in the neck of the bottle.

These and other objects of the invention will become apparent to those skilled in the art to which the invention pertains from the following specification when read in light of the annexed drawings.

DESCRIPTION OF THE PREFERRED EMBODIMENT OF THE INVENTION

Figure 1:
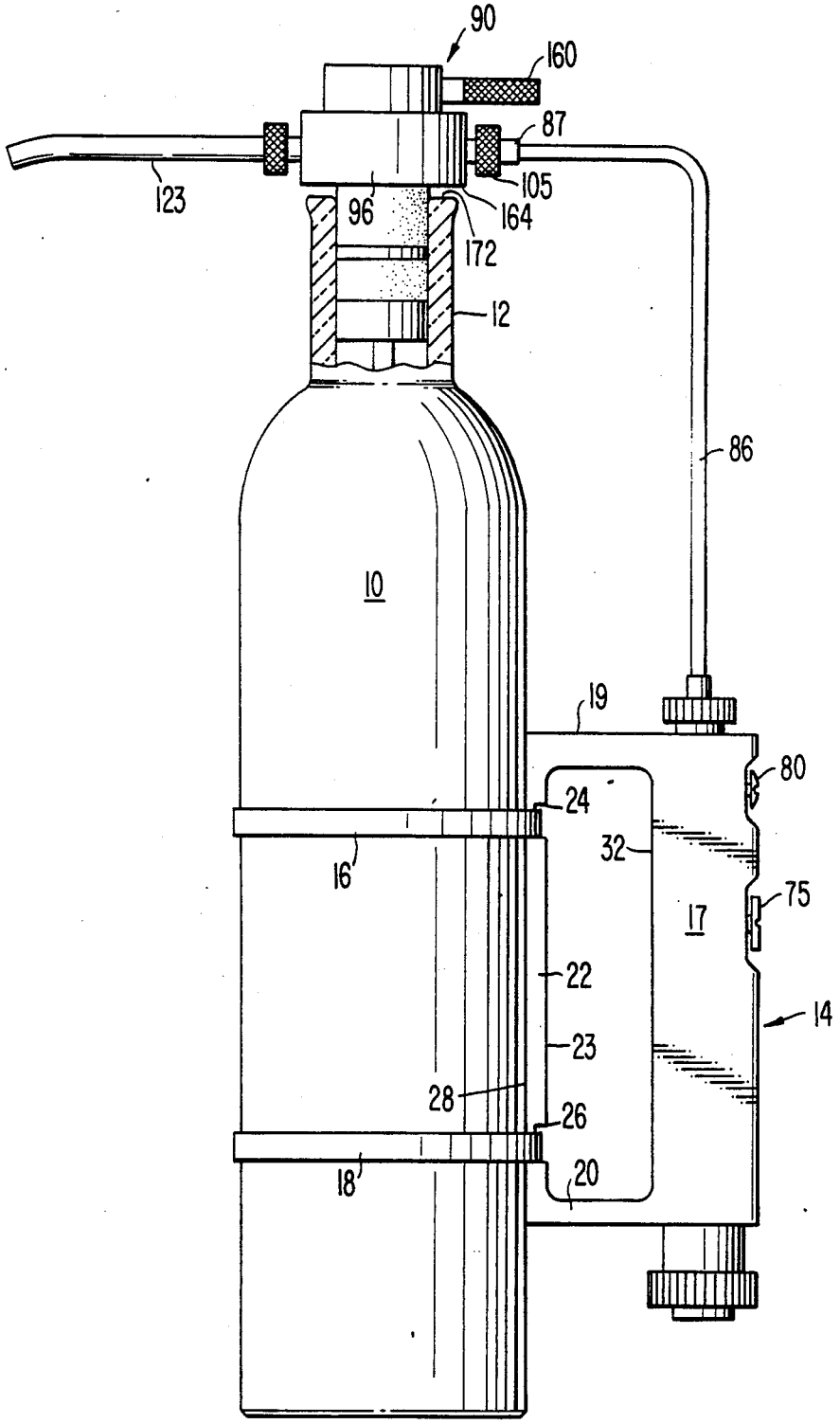
FIG. 1 is a perspective view of a wine bottle with a housing unit attached thereto and a stopper assembly in the neck thereof, a conduit connects the housing unit and the stopper assembly.
Figure 2:
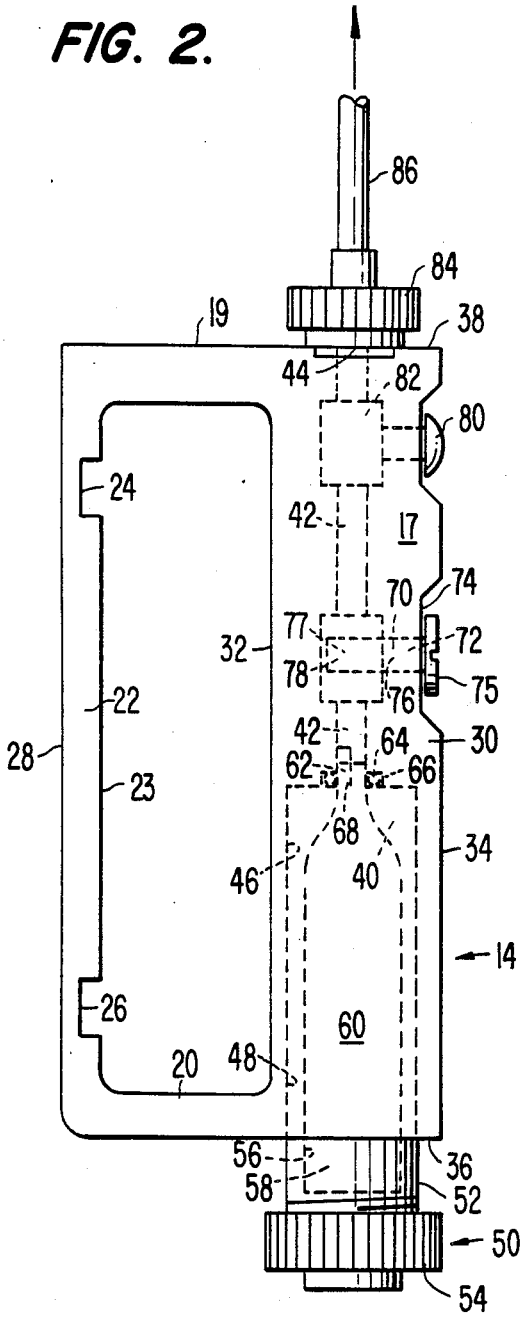
FIG. 2 is a perspective view of the housing incorporating a cartridge of pressurized gas, and controls for controlling the flow and pressure of said gas.

Referring now in more detail to the drawings, FIG. 1 shows a bottle 10 having the usual neck 12. A housing 14 is attached to the bottle 10 by adjustable straps 16 and 18. The housing 14, FIGS. 1 and 2, has a body portion 17 which functions as a hand grip, laterally extending arms 19 and 20 and a vertical section 22 having a pair of slots 24 and 26 in the inside wall 23. The outside wall 28 is flat but may be contured to compliment the curvature of the bottle. The strap 16 and 18 fit in the sltos 24 and 26 and have adjusting means to accommodate bottles of various diameters. The straps have fastening means whereby the housing 14 is tightly attached to the bottle.

The body portion 17 of housing 14 has opposing side walls 30, one shown, inside wall 32, an outside wall 34, a bottom wall 36 and a top wall 38. The body portion 17 has a chamber 40 extending for approximately one half the height of the housing and a passageway 42 communicating at one end with the chamber 40 and extending along the remainder of the body portion 17 to an open orifice 44 in the top wall 38. The chamber 40 has an inside wall 46 which is threaded at 48 to receive a plug 50. The plug 50 has a threaded wall 52 for mating with the threaded wall 48 of the chamber 40. The plug has a grip portion 54 and the wall 52 defines a well 56 to receive the end 58 of a pressurized cartridge 60 of an inert gas such as nitrogen. The cartridge 60 is held tightly in the chamber 40 by inward turning of the plug 50 which forces the neck 62 of the cartridge to air sealing engagement with the O-ring 64 positioned in a well 66 in the upper end of chamber 40. A piercing pin 68 or the like is used to puncture the seal of the cartridge in the usual fashion. It will be appreciated that O-ring seals the neck of the bottle in the well 66 whereby no gas will enter the chamber 40.

The body portion 17 of the housing 14 has a lateral channel 70 having an open port 72 in a recess 74 in the outside wall 34. The opposite end of the channel 70 has a port 76 communicating with the passage 42. A pressure control unit 75 is threaded into the channel 70 and has a stem 77 having a distal end 78 which extends into the channel 42. The channel 42 may be completely blocked by turning the control 75 clockwise thus extending the end 78 completely into the channel 42 thus closing same to the passage of pressurized gas. As will be appreciated, counterclockwise rotation of the control 75 will gradually open the channel 42 whereby gas of increased pressure will flow in the channel 42. A dispenser button 80 controls an open-shut valve 82 in the channel 42 whereby gas under pressure from the cartridge 60 may flow to the stopper assembly to be described below.

Figure 3:
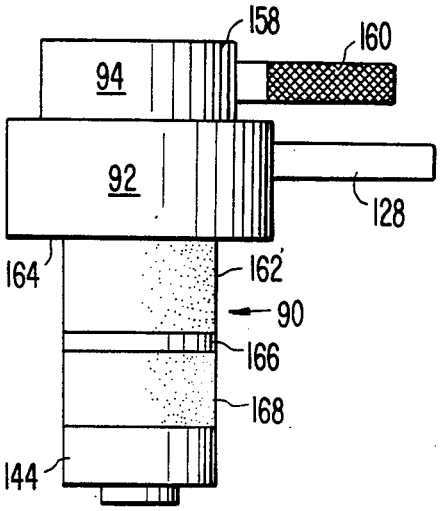
FIG. 3 is a perspective view of the stopper assembly.

The port 44 in the top wall 38 of the housing 14 is of a well-configuration and it is threaded to receive the threaded shank of a fitting 84 from which there extends a conduit line 86, the opposite end of said conduit being attached to the stopper assembly 90 FIGS. 1 and 3 by a suitable coupling.

The stopper assembly 90, FIGS. 1, 3, 4 and 5, comprises a stem 92, and a stopper expanding assembly 94. The stem 92 comprises a shank 95, FIGS. 6 and 7, and a head 96 which are of integral mass. A shank 95 has a vertical bore 98 communicating with a horizontal bore 100 in the head portion 96. The horizontal bore 100 terminates in a open port 102 having a connecting nipple 104 which receives the end 87 FIG. 2 of the conduit 86 leading from the housing 14. The nipple 104 and the end 87 of the conduit 86 are fastened together by a suitable coupling 105, FIG. 1. The opposite end of the bore 98 in the stem 95 terminates in an open port 106 which opens into a chamber 108 in the end of the stem distal from the head 96. A dip tube 110 having a bore 112 extending therethrough is press fitted into the chamber 108 to create an airtight seal therein. The bore 112 of the dip tube 110 communicates with the port 106. The opposite end of the bore 112 opens in a port 114.

The shank 95 has a second bore 116 identical to the bore 98 which communicates with a similar horizontal bore 118 in the head 96. The bore 118 terminates in a open port 120 in a connecting nipple 122. Connected to the nipple 122 is a dispensing spout 123, FIG. 1. The opposite end of the channel 116 opens in a port 17 in a chamber 119. Press fitted into the chamber 119 is a second dip tube 130 having a passage 132 extending completely therethrough. The passage 132 has an open port 135.

Figure 6:
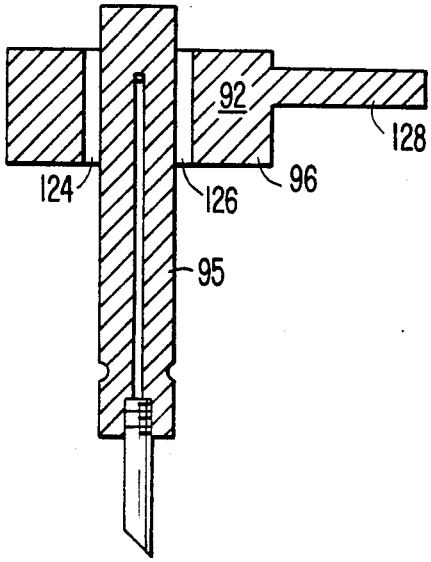
FIG. 6 is a top perspective sectional view of the stem of the stopper taken along the line 6—6 of FIG. 8.
Figure 7:
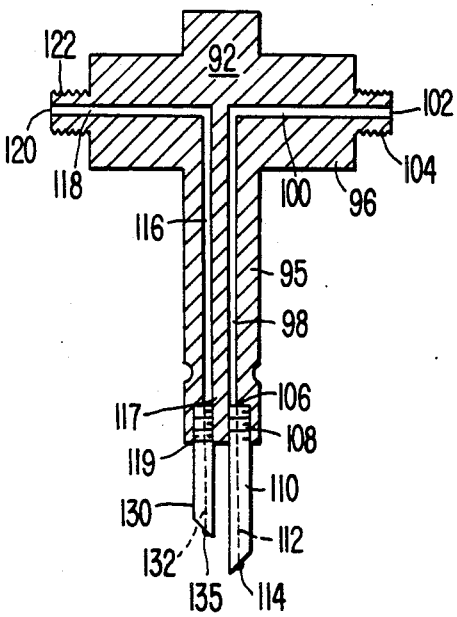
FIG. 7 is a perspective sectional view of the stem taken along the line 7—7 of FIG. 8 showing ingress and egress passages.
Figure 8:
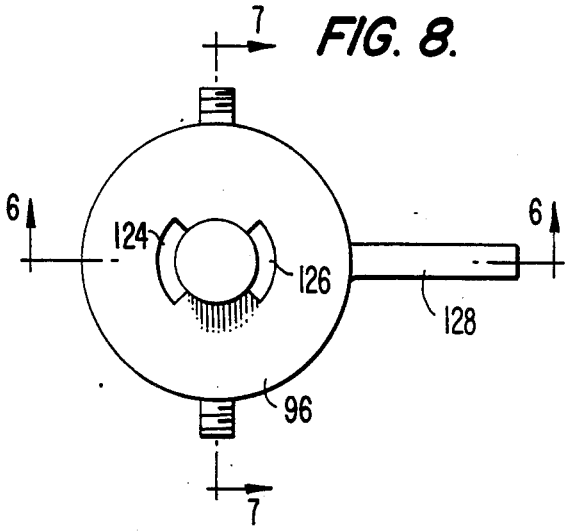
FIG. 8 is a top view of the stem showing opposed slots therethrough.
Figure 9:
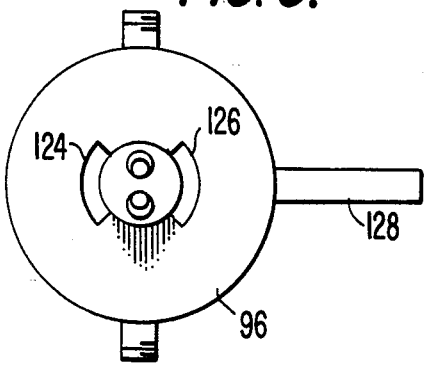
FIG. 9 is a bottom view of the stem looking in the direction of the arrow of FIG. 7.

As will be seen from FIGS. 6, 8, and 9 there are two slots 124 and 126 extending through the head 96 of the stem 92 to be more fully explained below. The head 96 has a lever arm 128 extending laterally therefrom.

Figure 4:
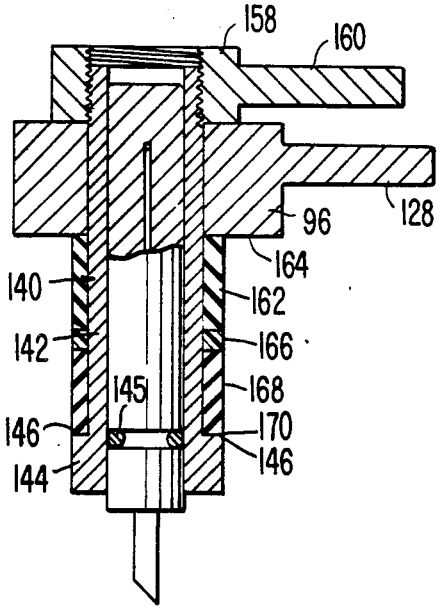
FIG. 4 is a perspective view in section of the stopper assembly.
Figure 5:
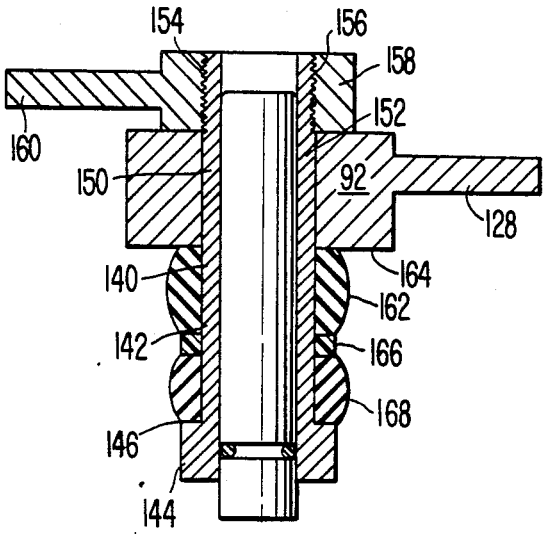
FIG. 5 is a perspective view in section of the stopper assembly showing the sealing means expanded.

Referring to FIGS. 3, 4 and 5, the stopper expanding assembly 94 comprises a slider 140 having a main body portion 142 terminating in an enlarged end portion 144 having a ledge 146. Extending above the main body portion 142 are a pair of ears 150 and 152 having threaded ends 154 and 156. The ears 150 and 152 are proportional to the dimensions of the slots 122 and 124 and extend therethrough a distance above the head 96. The threaded ends 154 and 156 receive a threaded nut 158 having an manipulable lever 160.

The slider 140 rides on the stem 95 and has a sealing O-ring 145. A first resilient and compressible band 162 is placed about the slider 140 on the main body portion 142 proximate to the under surface 164 of the head 96. Next to the band 162 is a rigid ring 166. Below the ring 166 is a second resilient and compressible band 168 having its lower edge 170 resting on the edge 146 of the slider 140.

In operation, the assembly shown in FIGS. 3, 4 and 5 is inserted into the neck 12 of the bottle 10 of FIG. 1 until the underside 164 of the head 96 rests on the top edge 172 of the bottle neck. Lever 160 is rotated counterclockwise relative to the lever 128 thus turning the nut 158 about the threaded ends 154 and 156 of the ears 150 and 152 of the slider 140. Rotation of the nut 158 draws the slider 140 upwardly. As slider 140 is drawn upwardly, the resilient and compressible bands 162 and 168 are compressed and thus expanded between the undersurface 164, ring 166 and the edge 146 of enlarge portion 144 of the slider 140. It will be thus appreciated that the bands 162 and 168 are compressed against the inside wall of the neck of the bottle thus creating an airtight seal. To dispense the wine in the bottle, a user grasps the housing in one and and depresses the control button 80 thereby opening the valve in the passageway 42. Gas under pressure from the cartridge 60 flows through the passsageway, the conduit line 86 and into the horizontal bore 100, through the vertical bore 98, through the bore 112 in the dip tube and into the bottle. The gas under pressure displaces the wine through the dip tube 130, vertical bore 116, horizontal bore 118 and finally through the spout 123. When sufficient wine has been dispensed, button 80 is released thus closing off the valve 82 in the channel 42. The pressure control 75 may be adjusted to increase or decrease the pressure in the channel 42.

The gas used in this case is an inert gas such as nitrogen. As will be appreciated, nitrogen is lighter than air and due thereto, a barrer of nitrogen will remain in the space left by the dispense wine. The atmospheric pressure remaining in the egress passages will prevent the egress of nitrogen from the bottle. Thus, the nitrogen functions as a protective barrer above the wine remaining in the bottle.

While the invention has been described with regard to a preferred embodiment thereof, it is will be appreciated to those skilled in the art that various changes and modifications may be made thereto without departing from the spirit or scope of the invention as set forth in the appended claims.

What is claimed is:

1. A dispenser for bottled liquid comprising:

a housing attached to a bottle containing liquid to be dispensed;

a source of pressurized gas in the housing;

a stopper for the bottle having a conduit connection to the housing and having a dispensing spout;

a first passageway in the stopper communicating with said conduit connection to said housing for the ingress of said pressurized gas to the inside of the bottle;

a second passageway in the stopper communicating with said spout for the egress of liquid from the bottle; and control means on the housing for controlling the flow and pressure of pressurized gas to the bottle whereby liquid may be dispensed from the bottle;

said stopper comprises a stem having a plurality of vertical bores and a head portion having a plurality of horizontal bores communicating with said vertical bores, a slider on the stem extending through slots in the head and having compressible and expanding means thereon, and means attached to the slider for compressing and expanding the compressible and expandable means against the neck of a bottle to create an airtight seal; and said slider comprises a main body portion having an enlarged end with an edge thereon and a pair of ears distal from the enlarged end, said ears being threaded and extending through slots in the head portion of the stem and a threaded nut attached to said ears.

* * * * *